US006993265B2

(12) United States Patent
Morgan

(10) Patent No.: US 6,993,265 B2
(45) Date of Patent: Jan. 31, 2006

(54) SEAL FOR TONER CARTRIDGE ASSEMBLY

(75) Inventor: John Morgan, Newbury Park, CA (US)

(73) Assignee: Dataproducts U.S.A., LLC, Thousand Oaks, CA (US)

( * ) Notice: Subject to any disclaimer, the term of this patent is extended or adjusted under 35 U.S.C. 154(b) by 0 days.

(21) Appl. No.: 10/680,619

(22) Filed: Oct. 7, 2003

(65) Prior Publication Data

US 2005/0074258 A1 Apr. 7, 2005

(51) Int. Cl.
*G03G 15/08* (2006.01)

(52) U.S. Cl. ..... 399/106; 399/109; 399/258

(58) Field of Classification Search ..... 399/109, 399/106, 102, 103, 119, 120, 258; 222/DIG. 1; 29/402.02, 402.03; 156/94
See application file for complete search history.

(56) References Cited

U.S. PATENT DOCUMENTS 4,930,684 A * 6/1990 Patterson ..... 222/DIG. 1 X
5,296,902 A 3/1994 Michlin ..... 399/109
5,799,712 A * 9/1998 Kelly et al. ..... 399/109 X
6,014,534 A * 1/2000 Goebel et al. ..... 399/106
6,552,780 B1 * 4/2003 Michlin et al. ..... 399/106
6,587,657 B2 * 7/2003 Sirejacob ..... 399/106
6,721,525 B2 * 4/2004 Wang et al. ..... 399/258
6,760,556 B2 * 7/2004 De Kesel et al. ..... 399/106

FOREIGN PATENT DOCUMENTS

JP 08-179613 A * 7/1996
JP 08-278739 A * 10/1996

* cited by examiner

*Primary Examiner*—Sophia S. Chen
(74) *Attorney, Agent, or Firm*—Kaplan Gilman Gibson & Dernier LLP

(57) ABSTRACT

A recharged toner cartridge assembly is disclosed in which a sealing member is provided between the toner hopper and the feed roller compartment to prevent leakage of the recharged toner powder. In particular, the sealing member is fixed to the bottom surface of the feed roller compartment before the compartment is brought to engage with the toner hopper, thus avoiding any inadvertent messing of the toner powder in the toner hopper.

8 Claims, 3 Drawing Sheets

SEAL FOR TONER CARTRIDGE ASSEMBLY

FIELD OF THE INVENTION

The present invention is related to toner cartridge technologies, in particular, to a sealing solution between the toner hopper and the feed roller compartment of a toner cartridge assembly, particularly a recharged toner cartridge assembly.

BACKGROUND OF THE INVENTION

Toner cartridges, in particular those used for copying machines, printers, fax machines, etc, are expensive. Thus it is advantageous to allow the recharging of toner cartridges after the toner powder is consumed. Such recharging saves cost and avoids additional disposal problems.

As show in FIG. 1, a toner cartridge assembly typically comprises a toner hopper 1 for accommodating the toner powder 6, and a feed roller compartment 2 communicating with the toner hopper 1 for dispensing toner power 6 through an opening 4 by a dispensing roller 3. Initially, the toner powder 6 is sealed by a sealing tape 7 of similar means that covers the opening communicating between the toner hopper 1 and the feed roller compartment 2. Before use of the assembly, the sealing tape 7 is removed so the toner powder 6 can fall through the opening to the feed roller compartment 2 to be dispensed. To avoid any leakage of the toner powder 6 from the engaging surfaces of the toner hopper 1 and the feed roller compartment 2, a weld sealing or other types of toner tight sealing method 5 is provided between the hopper 1 and the compartment 2.

In order to recharge the cartridge after the toner powder 6 is used up, the weld is usually destroyed so as to separate the toner hopper 1 and the feed roller compartment 2. The recharging process usually involves at least cleaning the cartridge, refilling it with new toner, and applying a new seal to prevent leakage of the toner powder from the space between the toner hopper and feed roller compartments. Since the originally supplied seal has been cut, a different method of providing this seal to prevent leakage is usually needed. The industry has relied upon felt, foam, or other similar seals, as explained, for example, in prior art U.S. Pat. No. 5,296,902 issued to Michlin.

The Michlin patent contains numerous drawbacks, including at least the requirement for slots and tools to slide the seal in from the side. It is also not convenient to handle and also somewhat complicated in view of its structure and components.

Thus, there is a need for a sealing solution which is simple in both structure and operation.

SUMMARY OF THE INVENTION

According to the present invention, a recharged toner cartridge assembly is provided, which comprises a toner hopper compartment containing recharged toner powder and a feed roller compartment for dispensing the toner power. The toner hopper has a generally flat upper surface with an opening, while the feed roller compartment has a generally flat bottom surface, also with an opening, for engaging with the upper surface of the toner hopper. A sealing member is provided between the two flat surfaces for sealing around the openings when the two flat surfaces engage each other after recharging. In particular, according to the present invention, the sealing member is adapted to be fixed to the bottom surface of the feed roller compartment before the two flat surfaces engage each other. Thus, because the sealing member is fixed to the feed roller compartment, the assembly is easy to handle without inadvertently spilling the toner powder from the toner hopper during the recharging and reassembling process. Preferably, the sealing member is a flat sealing foam which is adapted to be fixed to the bottom surface of the feed roller compartment by, not limited to adhesive, screws or pin-hole connections.

According to another aspect of the present invention, a sealing member is provided which is adapted to be fixed to the bottom surface of the feed roller compartment before the compartment engages with the toner hopper. Preferably, the sealing member is a flat sealing foam with adhesive on one surface, protected by a removable plastic tape before use.

According to a further aspect of the present invention, a method of sealing the recharged toner cartridge is provided, which comprises the steps of fixing a sealing member to the bottom surface of the feed roller compartment and around the opening of the bottom surface, and after recharging of toner powder to the toner hopper, engaging the feed roller compartment with the toner such that the sealing member is sandwiched therebetween around the openings.

In still another embodiment, a removable closure means is attached to the toner hopper compartment, but a slotted seal insert is attached to the feed roller compartment. For purposes of explanation herein, and not limitation, the closure means is indicated to be tape or ribbon and the slotted seal insert is a piece of sealing foam.

BRIEF EXPLANATION OF THE DRAWINGS

Further features and advantages will be clearer after reading the following detailed descriptions of the preferred embodiment according to the present invention with reference to the accompanying drawings, in which.

DETAILED DESCRIPTION OF THE INVENTION

Figure 2:
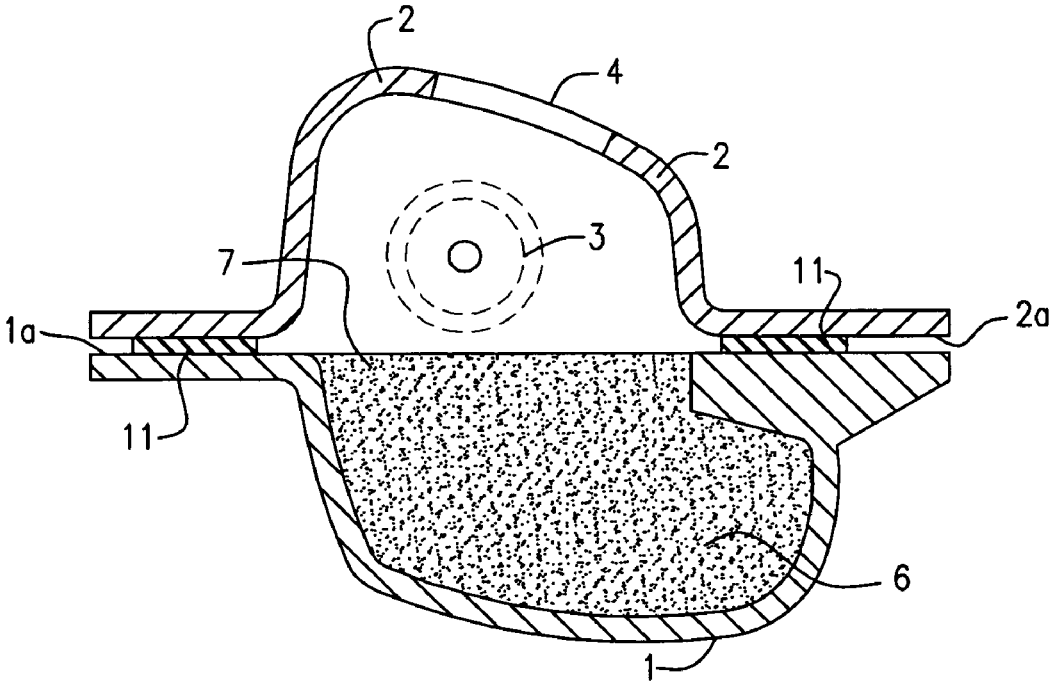
FIG. 2 is an illustration of an embodiment according to the present invention.

As shown in FIG. 2, after the toner cartridge assembly is recharged with toner powder 6, the feed roller compartment 2 and the toner hopper 1 are reassembled. A sealing member 11 is sandwiched between the flat bottom surface 2*a* of the feed roller compartment 2 and the flat upper surface 1*a* of the toner hopper 1, sealing around the communication opening between the two surfaces so as to prevent a leakage of the toner powder 6 from between the two surfaces.

According to the present invention, the sealing member 11 is fixed to the bottom surface 2*a* of the feed roller compartment 2 before the compartment 2 engages with the toner hopper 1 after the toner hopper is refilled with toner powder 6. Thus, handling of the sealing member 11 mainly involves the feed roller compartment 2 instead of the toner hopper 1, the inadvertent spilling of the toner powder contained in the toner hopper is minimized.

Figure 3:
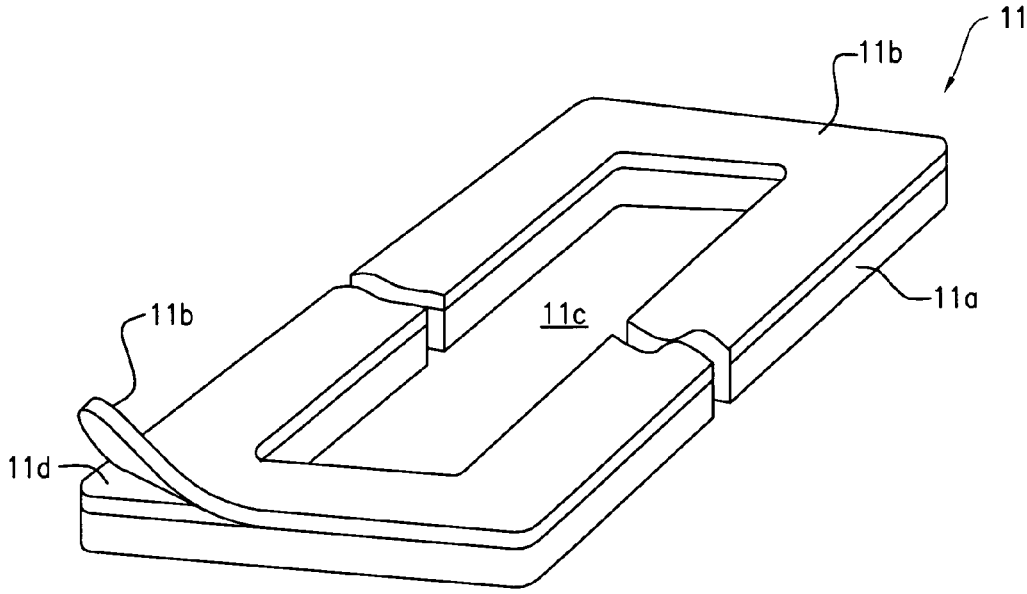
FIG. 3 shows an embodiment of the sealing member according to the present invention.

Preferably, the sealing member 11 is a flat sealing foam which assumes some resilience. As shown in FIG. 3, the sealing foam 11 is generally rectangular in shape, with a slot

11*c* in the middle which substantially matches the opening communicating between the toner hopper 1 and the feed roller compartment 2.

The sealing foam 11 in FIG. 3 comprises a foam body 11*a* with a protection layer 11*b* of plastic material. The foam body 11*a* has an upper surface 11*d* which comprises an adhesive. The upper surface 11*d* is normally covered by the protection layer 11*b*. Before use, the protection layer 11*b* is peeled off, and the foam body 11*a* can be attached to the bottom surface 2*a* of the feed roller compartment 2 by its adhesive upper surface 11*d*.

Figure 4A:
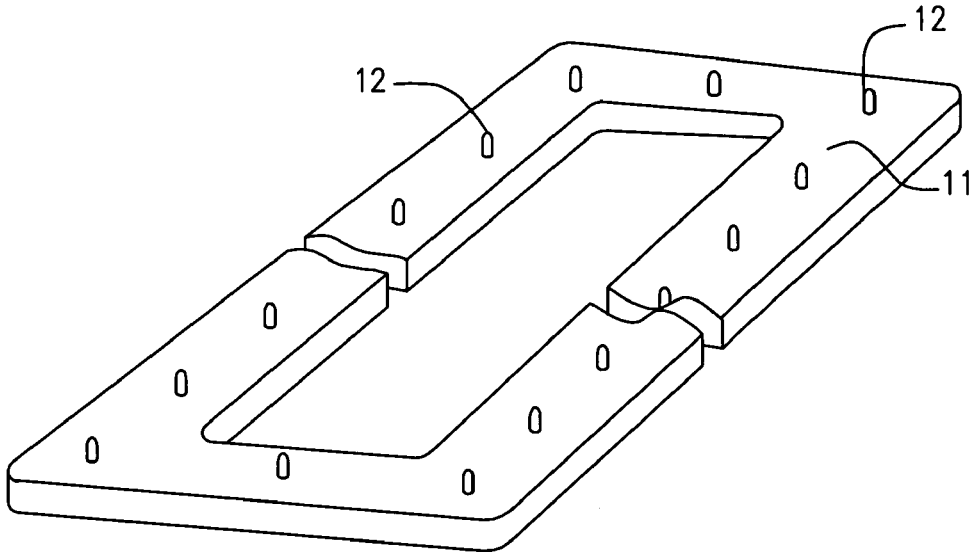
FIGS. 4*a* and 4*b* show another embodiment of the sealing member according to the present invention.
Figure 4B:
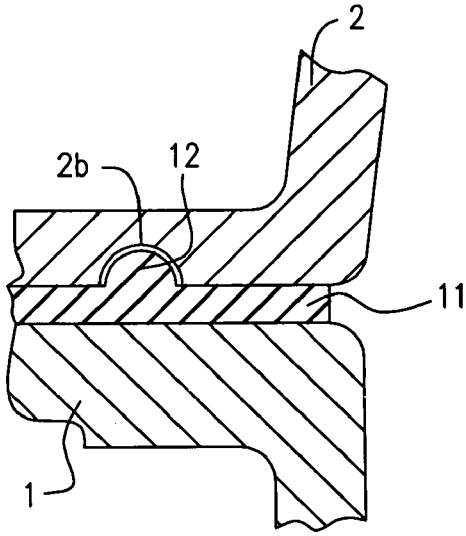

As alternatives, the sealing foam 11 can be fixed to the bottom surface 2*a* of the feed roller compartment 2 by mechanical connections such as screws or pin-hole connections. As shown in FIGS. 4*a* and 4*b*, the upper surface of the sealing foam 11 is provided with a plural of pins 12, which are suitable to insert into the matching holes 2*b* provided in the bottom surfaces 2*a*. The pins 12 may be an integral part of the sealing foam 11, made by a single molding process.

Alternatively, the pins 12 can be separate elements that are fixed to the sealing foam 11. Alternatively, the sealing foam 11 can be fixed to the bottom surface 2*a* of the feed roller compartment 2 by screws.

Figure 1:
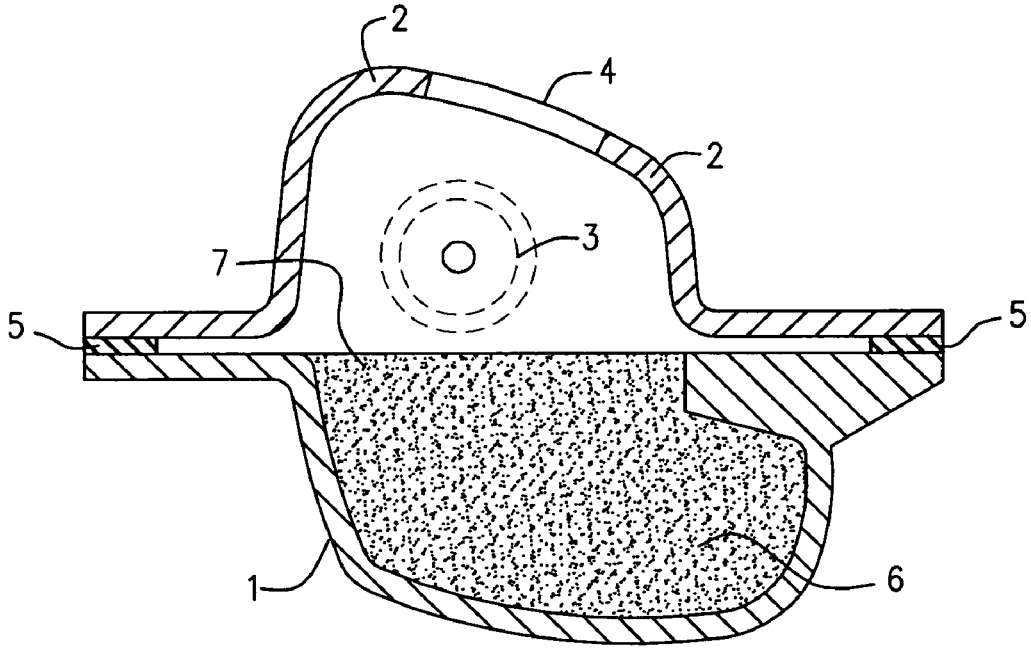
FIG. 1 is an illustration showing a toner cartridge assembly as initially assembled.

When the original toner powder 6 is used up, the feed roller compartment 2 is separated from the toner hopper 1 by destroying the weld 5 (see FIG. 1). According to the present invention, the sealing foam 11 is fixed to the bottom surface 2*a* of the feed roller compartment 2, e.g., by adhesive or pin-hole connections. A sealing tape 7 (FIG. 1) is put in position to cover the opening of the toner hopper 1 (which will be removed before next use). Before or after the toner hopper 1 is recharged with the toner powder 6, the feed roller compartment 2, with the sealing foam 11 attached to it, is brought to engage with the toner hopper 1. Thus, the sealing foam 11 is sandwiched between the bottom surface 2*a* of the feed roller compartment 2 and the upper surface 1*a* of the toner hopper 1, sealing around the opening communicating between the compartment 2 and the hopper 1, thus preventing a leakage of the toner powder 6 from between the surfaces 1*a* and 2*a*.

Although the closure means has been described as a sealing tape, the removable closure means may be other materials as well, such as a ribbon material that tears in the appropriate portions to expose the opening and allow the toner powder to enter the feed roller compartment 2 when appropriate. Such closure means are known in the art. It is also noted that the closure means can be attached to the toner hopper or can be attached to the sealing foam and/or feed roller compartment.

Though the above has described details of the preferred embodiments of the present invention, it shall be understood that, without departing the spirit of the present invention, numerous changes, adaptations and amendments are possible to a person skilled in the art. For example, instead of being placed on the toner hopper 1, the sealing plastic tape 7 can be placed between the sealing foam 11 and the bottom surface 2*a* after recharging. Thus, the protection scope of the present invention is intent to be solely defined by the accompanying claims.

What is claimed is:

1. A recharged toner cartridge assembly comprises:

a toner hopper for containing recharged toner powder, said toner hopper having a generally flat upper surface with an opening;

a feed roller compartment for dispensing said toner power, said feed roller compartment having a generally flat bottom surface with an opening for engaging with said upper surface of said toner hopper;

a sealing member provided between said two flat surfaces for sealing around said openings when said two flat surfaces engage each other after recharging;

wherein said sealing member is adapted to be fixed to said bottom surface of said feed roller compartment before said two flat surfaces engage each other, said sealing member is a flat sealing foam with a slot which matches said openings, and said sealing foam has an upper surface adapted to be fixed to said bottom surface of said feed roller compartment by an adhesive.

2. The recharged toner cartridge assembly of claim 1 wherein said upper surface of said sealing foam comprises said adhesive, which is protected by a protective sheet before said protective sheet is removed.

3. A method of sealing a recharged toner cartridge assembly including a toner hopper having a flat upper surface with an opening and a feed roller compartment having a flat bottom surface with an opening, comprising the steps of:

fixing a sealing member to said bottom surface of said feed roller compartment, and around said opening of said bottom surface; and after recharging of toner powder to said toner hopper, engaging said feed roller compartment with said toner hopper such that said sealing member is sandwiched between said two flat surfaces around said openings.

4. The method of claim 3 wherein said sealing member is fixed to said bottom surface of said feed roller compartment by an adhesive.

5. The method of claim 4 wherein said sealing member is a flat sealing foam with an upper surface provided with an adhesive protected by a removable protective sheet.

6. The method of claim 3 wherein said sealing member is fixed to said bottom surface of said feed roller compartment by a mechanical fixture.

7. The method of claim 6 wherein said mechanical fixture comprises a plurality of screws.

8. The method of claim 6 wherein said mechanical fixture comprises a plurality of pin-hole connections.

* * * * *